US006883618B1

(12) United States Patent
Pascale

(10) Patent No.: US 6,883,618 B1
(45) Date of Patent: Apr. 26, 2005

(54) VARIABLE TIMING FOR FRONT CHAMBER OF PNEUMATIC HAMMER

(75) Inventor: Jack H. Pascale, Greentown, PA (US)

(73) Assignee: Numa Tool Company, Thompson, CT (US)

( * ) Notice: Subject to any disclaimer, the term of this patent is extended or adjusted under 35 U.S.C. 154(b) by 0 days.

(21) Appl. No.: 10/868,589

(22) Filed: Jun. 15, 2004

(51) Int. Cl.[7] ..... E21C 4/14

(52) U.S. Cl. ..... 173/91; 173/17; 173/136; 175/296

(58) Field of Search ..... 173/13, 17, 19, 173/91, 135, 136, 78; 175/92, 296

(56) References Cited

U.S. PATENT DOCUMENTS 2,924,690 A * 2/1960 Strom et al. ..... 218/59
4,133,393 A * 1/1979 Richards ..... 173/64
4,333,537 A * 6/1982 Harris et al. ..... 173/17
4,530,408 A * 7/1985 Toutant ..... 173/17
4,932,483 A * 6/1990 Rear ..... 175/296
5,205,363 A 4/1993 Pascale ..... 173/17
5,419,403 A * 5/1995 Klemm ..... 173/115
5,564,510 A * 10/1996 Walter ..... 175/296
5,715,897 A * 2/1998 Gustafsson ..... 175/296
5,915,483 A * 6/1999 Gien ..... 173/91
5,984,021 A 11/1999 Pascale ..... 173/90
6,499,544 B1 * 12/2002 Shofner ..... 173/91

* cited by examiner

*Primary Examiner*—Scott A. Smith
(74) *Attorney, Agent, or Firm*—Alix, Yale & Ristas, LLP

(57) ABSTRACT

The lower end portion of a pneumatic impact hammer cylinder has at least one upper fluid passage and at least one lower fluid passage. A U-shaped sleeve is mounted in a circumferential groove in the lower end portion of the piston. The sleeve includes a base, upper and lower legs extending radially outward from the base, and a cavity extending axially between the legs. The sleeve has an axial length that is less than the axial length of the piston groove such that the sleeve is slidably movable within the piston groove between an upstroke position and a downstroke position. The upper fluid passage and the lower fluid passage cooperate with the sleeve cavity, as the piston reciprocates between the impact position and the recovery position, to supply pressure fluid to the impact end of the operating chamber for a portion of each upstroke and each downstroke. The portion of each downstroke during which pressure fluid is supplied to the impact end of the operating chamber is less than the portion of each upstroke during which pressure fluid is supplied to the impact end of the operating chamber.

17 Claims, 9 Drawing Sheets

VARIABLE TIMING FOR FRONT CHAMBER OF PNEUMATIC HAMMER

BACKGROUND OF THE INVENTION

This invention relates generally to pneumatic impact hammers of the type having an impact piston and a fluid delivery tube received within a coaxial bore in the piston for supplying pneumatic pressure fluid to one or both ends of the piston operating chamber for reciprocation of the piston.

U.S. Pat. No. 5,205,363 discloses a pneumatic impact drill having a porting system for automatically supplying pneumatic pressure fluid from a fluid delivery tube received within a coaxial bore in the impact piston to the opposite ends of the piston operating cylinder as the piston reciprocates. The porting system comprises an annular set of equiangularly spaced outlet ports in the fluid delivery tube and two sets of radially extending bores in the piston having first and second, axially spaced, annular sets of equiangularly spaced inlet ports which cooperate with the outlet ports in the delivery tube. The number of inlet ports in the piston and the number of outlet ports in the supply tube are selected to provide substantial fluid communication therebetween at all relative angular positions of the piston and fluid delivery tube.

Such invention provides a new and improved porting system. However, this porting system uses a single fluid delivery tube port to complete alternative flow paths for the two axially spaced piston ports and requires axial piston movement to initiate transfer from the first flow path to the second flow path. Consequently, pressure conditions that impede the movement of the piston can exist while the fluid delivery tube port is positioned intermediate the two piston ports.

U.S. Pat. No. 5,984,021 discloses a pneumatic impact drill having a porting system for automatically supplying pneumatic pressure fluid from a fluid delivery tube received within an axial bore in the impact piston to the opposite ends of the piston operating cylinder as the piston reciprocates. A flange on the delivery tube is slidably mounted in a cavity in a mounting hub assembly. Passageways provide fluid communication between the pressure fluid inlet plenum and the operating chamber side of the cavity and between the back chamber and the inlet plenum side of the cavity. Fluid pressure forces acting on the opposite faces of the flange and on the top end surface of the delivery tube reciprocate the delivery tube between upstroke and downstroke positions. Positioning the delivery tube in the upstroke position increases the axial distance that the piston must travel before the pressure fluid supply is connected to the back end of the operating chamber on the piston upstroke. Positioning the delivery tube in the downstroke position increases the axial distance the piston must travel before the pressure fluid supply is disconnected from the back end of the operating chamber on the piston downstroke. While the porting system of this invention addresses the deficiencies discussed above, pressure applied to the front chamber of the piston during the downstroke reduce the impact energy produced by the piston.

SUMMARY OF THE INVENTION

It is an object of the invention to provide in a pneumatic impact hammer of the type described, a new and improved cylinder including a lower end portion having at least one upper fluid passage, at least one lower fluid passage, and a land having a sealing surface disposed therebetween. The lower end portion of a piston disposed in the cylinder has a circumferential groove having an axial length ($G_L$), forming circumferential upper and lower shoulders. A U-shaped sleeve mounted within the piston groove includes a base, upper and lower legs extending radially outward from the base to an outer surface, and a cavity extending axially between the legs. The sleeve has an axial length ($SC_L$) that is less than the axial length of the piston groove such that the sleeve is slidably movable within the piston groove between an upstroke position and a downstroke position. The upper fluid passage and the lower fluid passage cooperate with the sleeve cavity as the piston reciprocates between the impact position and the recovery position such that the impact end of the operating chamber is supplied with pressure fluid from the pressure fluid inlet plenum for a portion of each upstroke and a portion of each downstroke. The portion of each downstroke during which pressure fluid is supplied to the impact end of the operating chamber is less than the portion of each upstroke during which pressure fluid is supplied to the impact end of the operating chamber.

Other objects and advantages of the invention will become apparent from the drawings and specification.

BRIEF DESCRIPTION OF THE DRAWINGS

The present invention will be better understood and its numerous objects and advantages will become apparent to practitioners in the art by reference to the accompanying drawings in which.

DETAILED DESCRIPTION OF THE PREFERRED EMBODIMENT

Figure 1A:
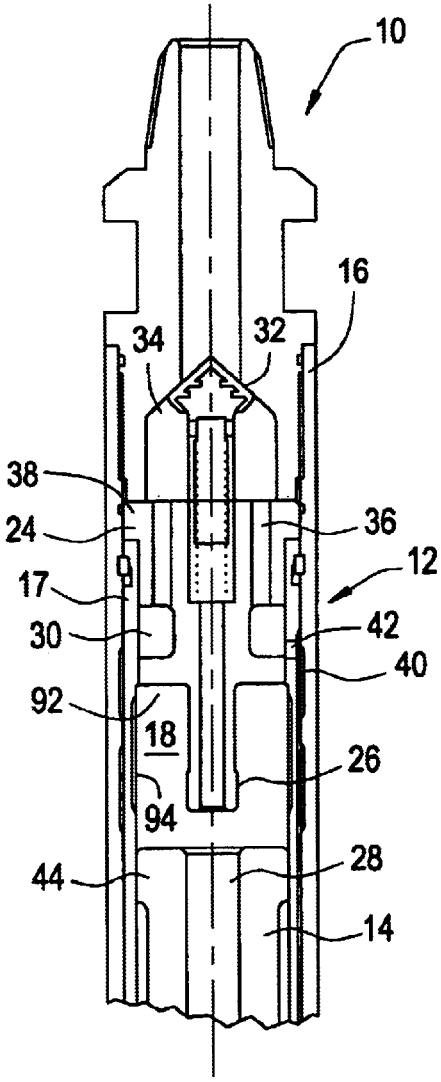
FIGS. 1*a* and 1*b* together provide a longitudinal section view, partly broken away and partly in section, of a downhole impact drill incorporating the present invention and showing an impact piston of the drill in a lower or impact position thereof.

In the drawings, the same numerals are used to designate the same or like parts. The porting system of the present invention has notable utility in downhole impact drills.

FIG. 1 shows a downhole impact drill 10 having an impact hammer 12 incorporating the subject porting system. The downhole hammer 12 has an impact piston 14 reciprocable and rotatable within an outer tubular casing or outer cylinder 16 and a sheath or inner cylinder 17. The inner and outer cylinders 17, 16 form a piston operating chamber 18 and the inner cylindrical surface 50, 20 supports the piston 14 for reciprocation. The piston 14 is reciprocated to impact a drill bit 22 mounted within the lower end of the casing 16 in a conventional manner for downhole percussive drilling in a well-known manner.

A distributor 24 is coaxially mounted within the upper end of the outer cylinder 16 for supplying pneumatic pressure fluid for reciprocating the piston 14. The lower end portion 26 of the distributor 24 is received within a coaxial through bore 28 in the piston 14. During drilling, pressure fluid is continuously supplied to the annular reservoir 30 in the distributor 24 via an inlet check valve 32, an inlet plenum 34, and ports 36 in the upper end portion 38 of the distributor 24. Preferably, the fluid is composed of air compressed up to 350 psi or more and a selected amount of lubricating oil and water coolant. Pressure fluid is supplied from the reservoir 30 to an axially extending fluid passage 40, formed between the outer cylinder 16 and the inner cylinder 17, via one or more radially extending bores 42 in inner cylinder 17.

The piston 14 has oppositely disposed upper and lower end portions 44, 46. The upper end portion 44 has an outside diameter that is closely matched to the inside diameter of the inner cylinder 17 such that the outer surface 48 of the upper end portion 44 and the inner surface 50 of the inner cylinder 17 form a substantially fluid tight seal. The piston lower end portion 46 is located in a region of the outer cylinder 16 having angularly spaced upper fluid passages 52 and angularly spaced lower fluid passages 54, with land 56 having a sealing surface 58 disposed therebetween. The outside diameter $D_{LEP}$ of the lower end portion 46 and the inside diameter 60 of the outer cylinder 16 (including sealing surface 58) are closely matched by grinding and honing the parts to provide a fluid seal therebetween. A circumferential groove 62 extends axially from the bottom of the upper end portion 44 to the top of the lower end portion 46. The impact end segment 64 of the lower end portion may have an outside diameter $D_{IES}$, where $D_{IES}<D_{LEP}$.

The piston lower end portion 46 has a circumferential, axially extending, undercut or groove 66 forming circumferential upper and lower shoulders 68, 70. Each of the shoulders 68, 70 has an outer surface 72 and an outside diameter $D_{LEP}$. A U-shaped sleeve 74 is mounted within the groove 66, with the legs 76, 78 of the sleeve 74 extending radially outward from the base 80 of the sleeve 74 and defining an axially extending cavity 82 therebetween. Preferably, the sleeve 74 is composed of a high impact strength composite polymer material. The sleeve 74 is manufactured as a "split ring", assembled around the piston within groove 66, and the two ring-halves are mounted together by an adhesive or mechanical bonding. The outside diameter of the legs 76, 78 is substantially equal to the outside diameter $D_{LEP}$ of the piston lower end portion 46. The inside diameter of the sleeve base 80 and the outside diameter of the floor of the groove 66 are closely matched by grinding and honing the parts, providing slidable movement therebetween while maintaining a fluid seal.

Figure 1B:
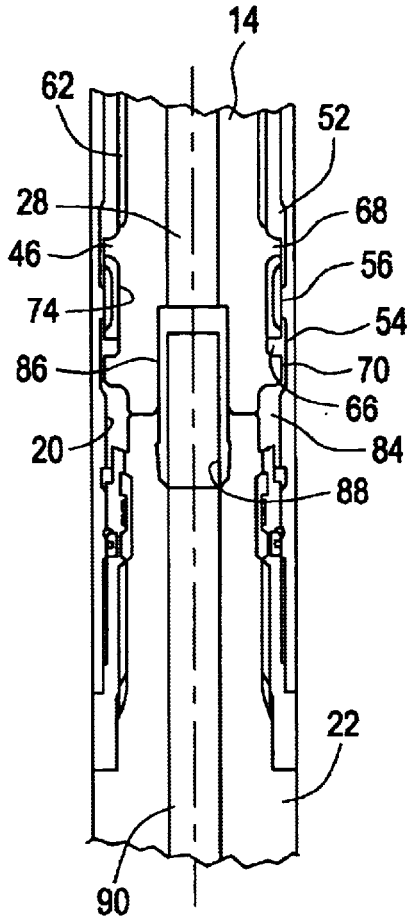

The exhaust connection to the front chamber 84 is provided by an exhaust tube 86 having a lower end portion mounted within an axial bore 88 in the upper end of the drill bit 22. The exhaust tube 86 and axial bore 88 form part of an exhaust passageway 90 leading to the lower end of the bit 22. The upper end portion of the exhaust tube 86 is slidably received within the lowest section of the piston bore 28. For example, with the impact piston 14 in engagement with the drill bit 22 as shown in FIG. 1*b*, the back chamber 92 is connected to the exhaust passageway 90 via bore 28.

For reciprocating the piston 14, the opposite ends of the piston operating chamber 18 are sequentially connected to exhaust and to receive pressure fluid from the reservoir 30. As the piston 14 reciprocates, the upper non-impact end of the operating chamber, or back chamber 92, is timely connected to exhaust and pressure fluid is timely supplied to the lower impact end of the operating chamber, or front chamber 84, to raise or withdraw the piston 14 for a succeeding downward impact stroke. Pressure fluid is timely supplied to the back chamber 92, first to decelerate the upward movement of the piston 14 and then to actuate the piston 14 downwardly to impact the drill bit 22. Similarly, as the piston 14 reciprocates, the front chamber 84 is timely connected to exhaust to provide for actuating the piston 14 downwardly with the fluid pressure in the back chamber 92.

Figure 3A:
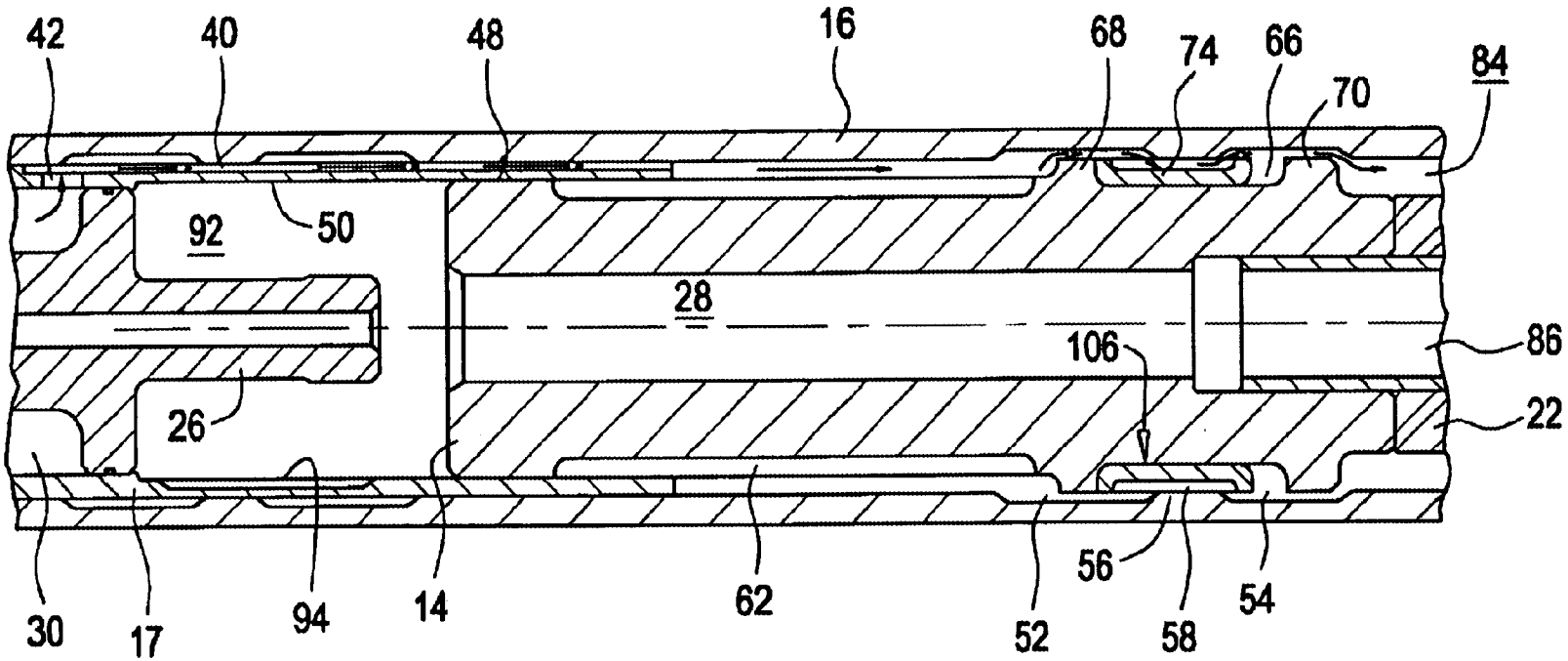
FIGS. 3*a* through 3*d* are enlarged longitudinal section views of the distributor, cylinder, impact piston, sleeve, drill bit and exhaust tube of FIG. 1 showing the positions of the sleeve and the impact piston as the impact piston and fluid delivery tube progressively cycle through a complete stroke from just prior to impact (3*a*), at the beginning of the upward stroke (3*b*), just prior to the end of the upward stroke (3*c*), and at the beginning of the downward stroke (3*d*).
Figure 3B:
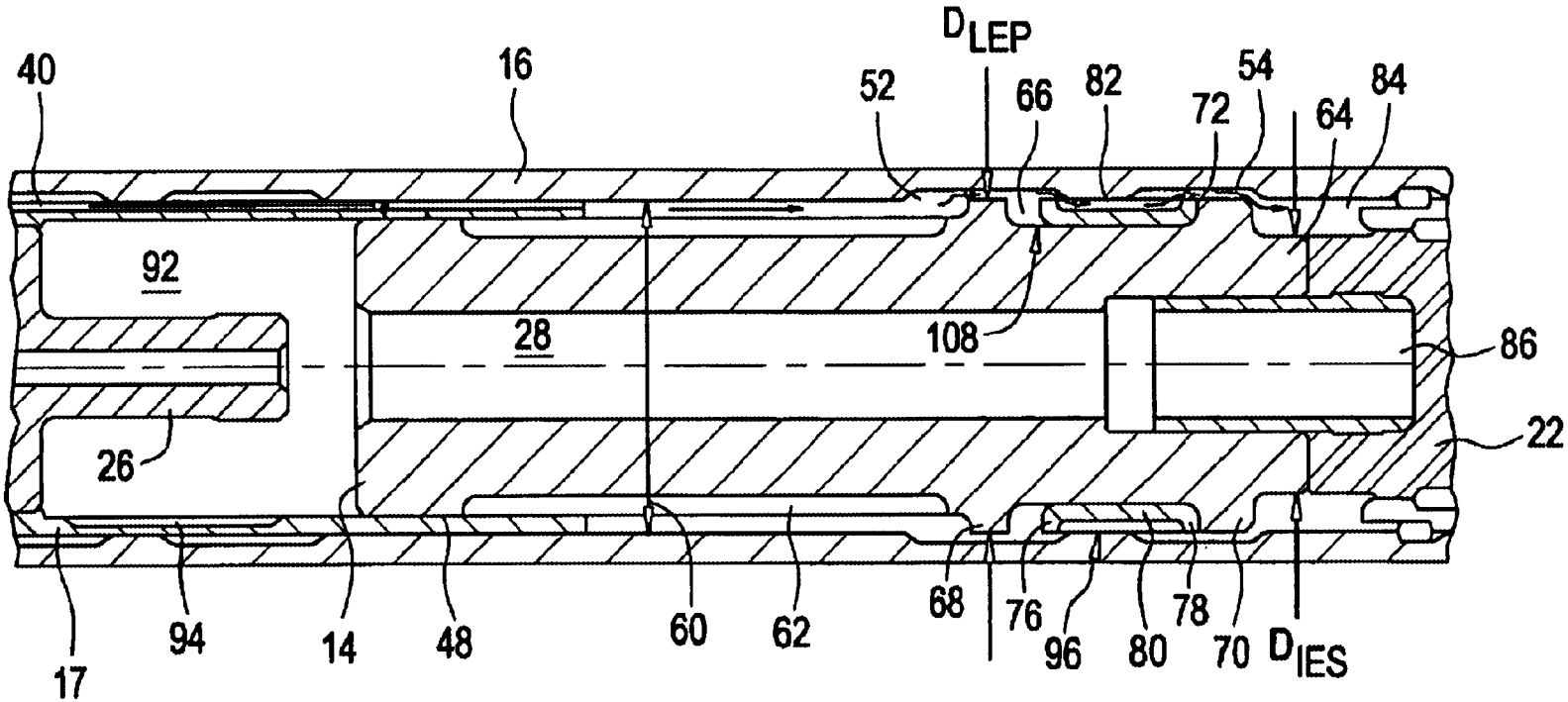
Figure 3C:
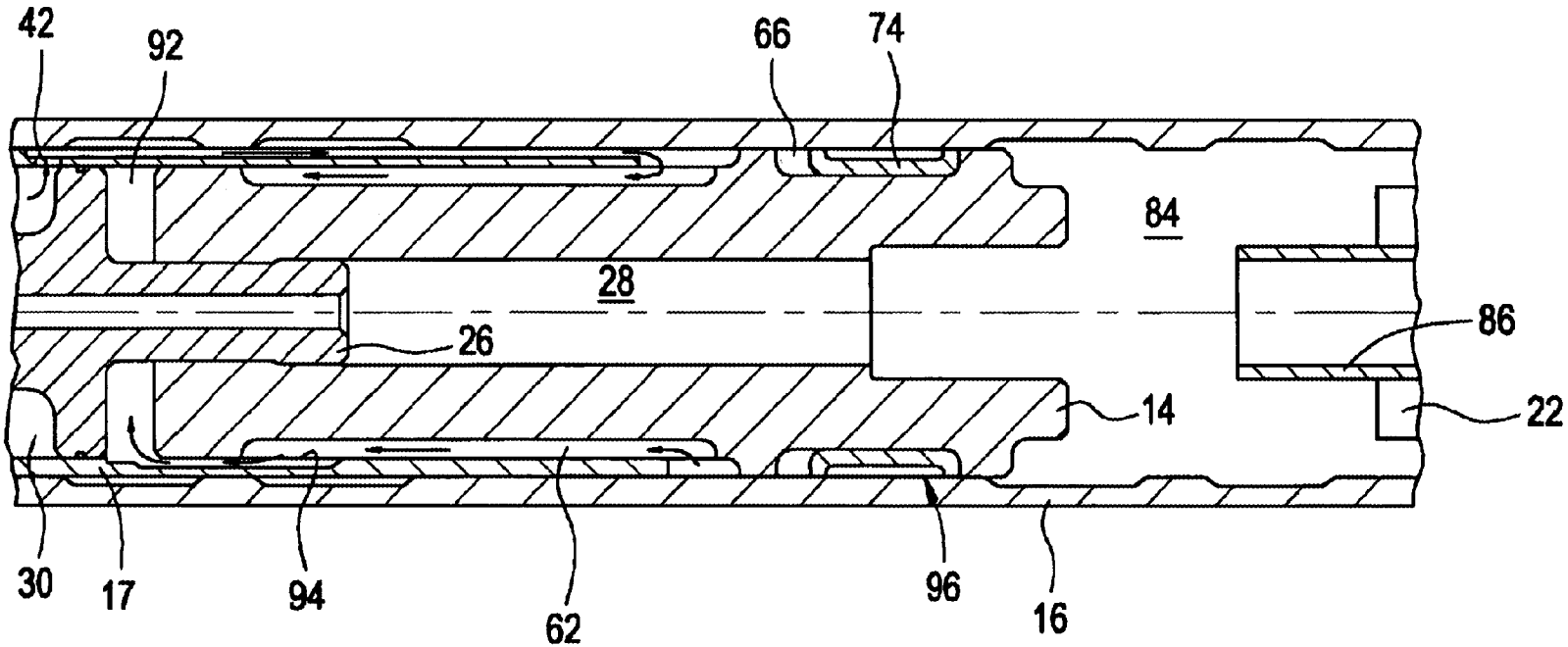

With the impact piston 14 in engagement with the drill bit 22 and the sleeve 74, pressure fluid is supplied from the reservoir 30 to the front chamber 84 through bore 42, the fluid passages 40, the piston grooves 62, the upper fluid passage 52, the sleeve cavity 82, and the lower fluid passage 54, and the back chamber 92 is connected to exhaust via the bore 28 to provide for raising or withdrawing the piston 14 from the bit 22 (FIG. 3*b*). As the piston 14 moves upwardly, the fluid pressure connection to the front chamber 84 terminates when the lower shoulder 78 of sleeve 74 sealingly engages the sealing surface 58 of land 56. The piston 14 continues to be actuated upwardly by the pressure below the piston 14 such that the distributor lower end portion 26 is received in the piston bore 28 to seal the back chamber 92 from the exhaust and the exhaust tube 86 is withdrawn from the bore 28 in the piston lower end portion 46 to connect the front chamber 84 to exhaust. As the upward movement of the piston 14 pressurizes the fluid in the back chamber 92 and the pressure in the front chamber 84 drops, the upward velocity of the piston 14 decreases. When the upper end portions of grooves 62 move into registry with an axially extending recess 94 in the inner cylinder 17, pressure fluid is supplied to the back chamber 92 to increase the rate of deceleration such that the upper end portion of recess 94 remains open to the back chamber 92 when the piston 14 finally stops in the up position (FIG. 3*c*).

After the upward movement of the piston 14 is halted (FIG. 3*d*), the front chamber 84 continues to be connected to the exhaust via the exhaust tube 86 and the reservoir 30 continues to supply pressure fluid to the back chamber 92 via bores 42, fluid passage 40, piston grooves 62 and recess 94, further increasing the pressure force on the upper end surface of the piston 14 and accelerating the piston 14 downward toward the bit 22. As the piston 14 moves downwardly, the pressure connection to the back chamber 92 terminates when the piston upper end portion 44 sealingly engages the inner surface 50 of the inner cylinder 17. The piston 14 continues to be actuated downwardly to impact with the bit 22 by the pressure above the piston 14, with the exhaust tube 86 being received within the bore 28 in the piston lower end portion 46 to seal the front chamber 84 from the exhaust and then the distributor lower end portion 26 being withdrawn from the bore 28 in the piston upper end portion 44 to connect the back chamber 92 to exhaust. Similar to most conventional downhole impact drills, pressure fluid is supplied to the front chamber 84 before the piston 14 impacts the bit 22, in preparation for reinitiating the cycle.

In conventional downhole impact drills, the geometry of the fluid passages between the pressure fluid supply and the front chamber dictates that pressure fluid is supplied to the front chamber for the same distance of travel on the piston downstroke as on the piston upstroke. The pressure fluid admitted to the front chamber on the piston downstroke exerts a pressure force on the piston lower face that retards the downward movement of the piston. Since the impact energy produced by the piston is a function of the square of the velocity on impact, this retarding force significantly reduces the impact energy produced by the piston.

The subject downhole impact drill utilizes sleeve 74 and groove 66 to produce a variable length port 96 that effectively reduces the length of travel on the piston downstroke during which pressure fluid is supplied to the front chamber 84 without producing an equivalent reduction in the length of travel on the piston upstroke during which pressure fluid is supplied to the front chamber 84. Specifically, the axial movement of sleeve 74 within groove 66 produces a port 96 that has an effective axial length that is shorter on the piston downstroke than on the piston upstroke.

Figure 3D:
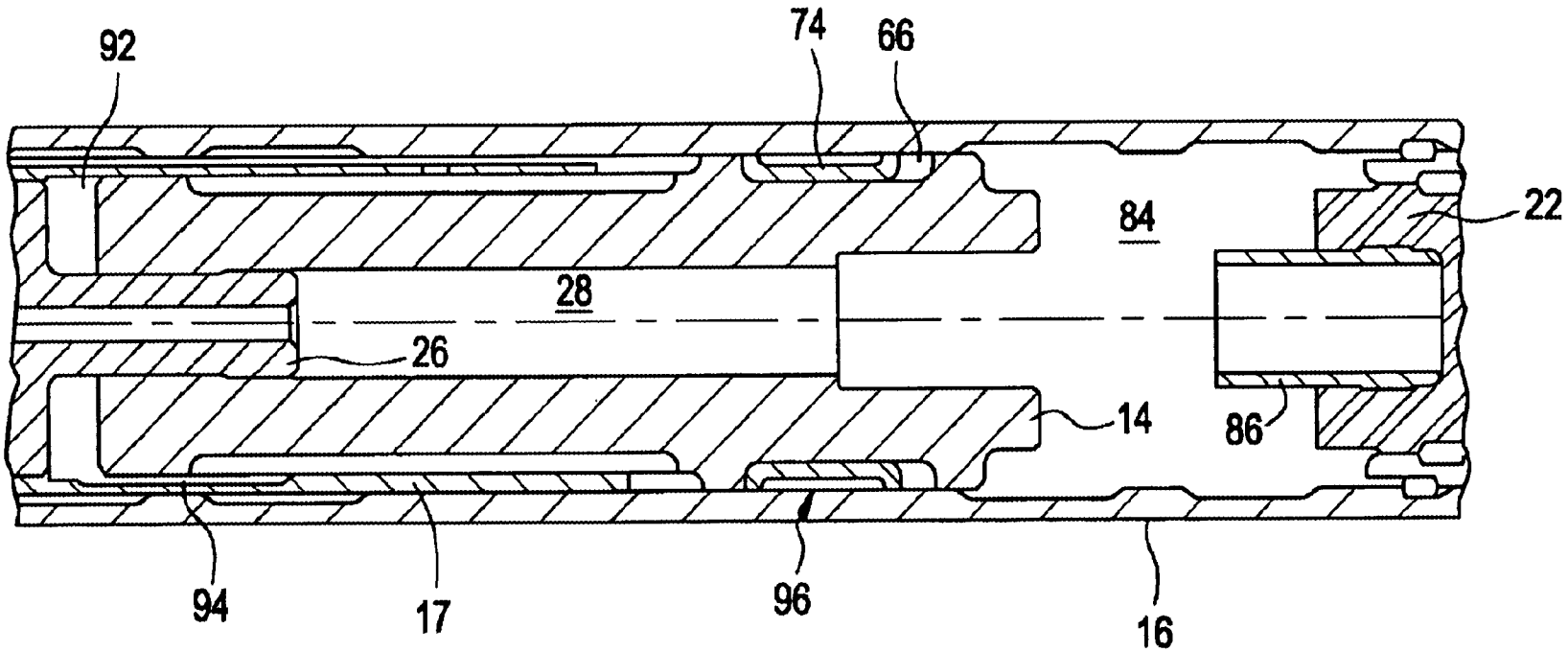

As shown in FIG. 3*a*, sleeve 74 is positioned in the upper portion of groove 66 (the downstroke position 106) during the piston downstroke until the downward motion of the piston 14 is halted by impact with the bit 22. Although such impact stops the piston 14, inertia causes the sleeve 74 to move axially downward within groove 66 until the sleeve 74 contacts the lower shoulder 70, the upstroke position 108 (FIG. 3*b*). As the piston 14 is accelerated upward on the upstroke, inertia continues to hold the sleeve 74 in contact with the lower shoulder 70. As the piston 14 decelerates to a stop at the end of the upstroke, inertia causes the sleeve 74 to move axially upward within groove 66 until the sleeve 74 contacts the upper shoulder 68, the downstroke position 106 (FIGS. 3*c* and 3*d*). The upward axial movement of the sleeve 74 may commence as the piston 14 is initially decelerated by compression of the pressure fluid in the back chamber 92, as described above.

Figure 2A:
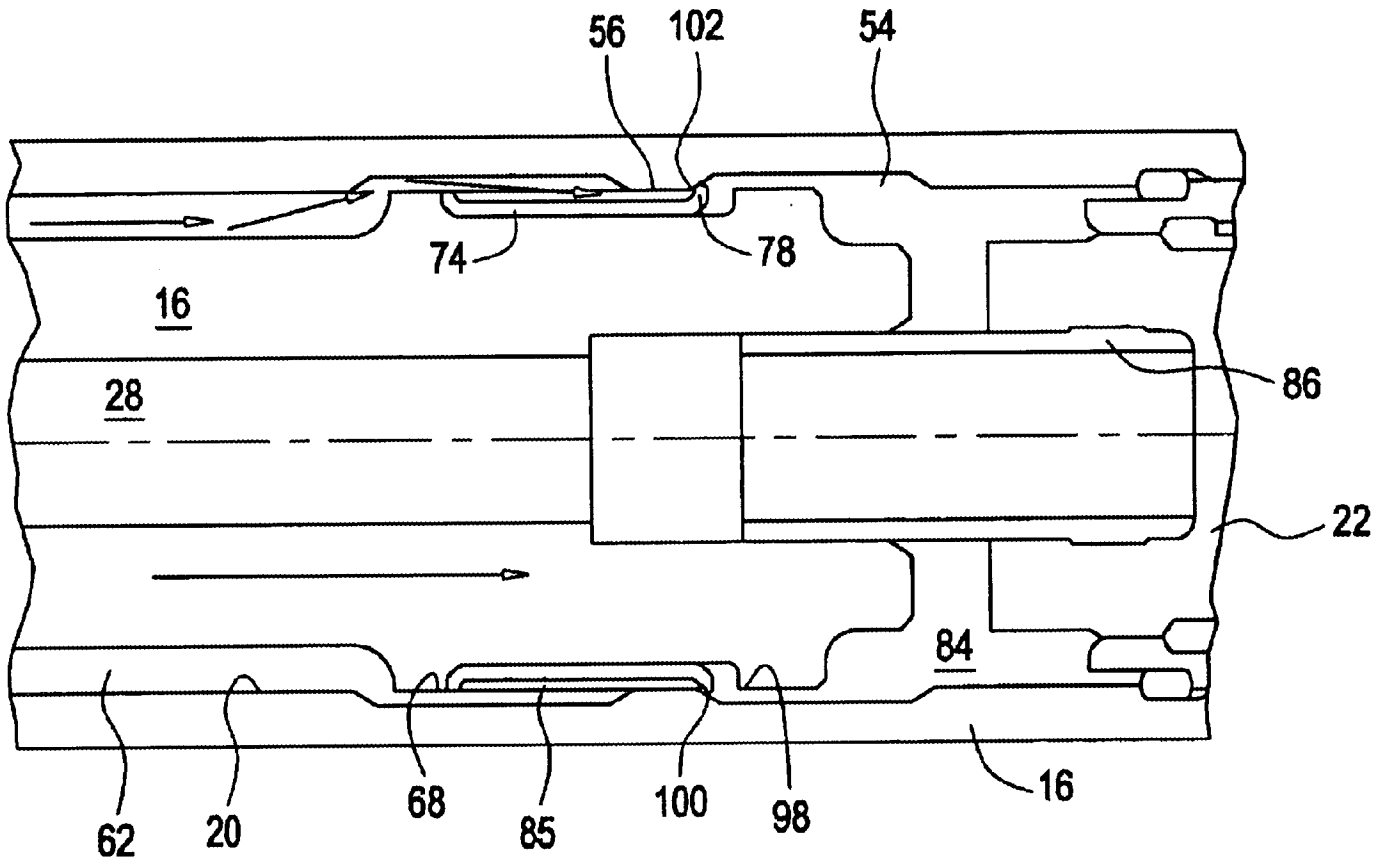
FIGS. 2*a* through 2*d* are enlarged longitudinal section views, of the outer cylinder, impact piston, sleeve, drill bit and exhaust tube of FIG. 1 showing the positions of the sleeve and the impact piston as the piston completes the downstroke (2*a*, 2*b*) and as the piston starts the upstroke (2*c*, 2*d*)
Figure 2B:
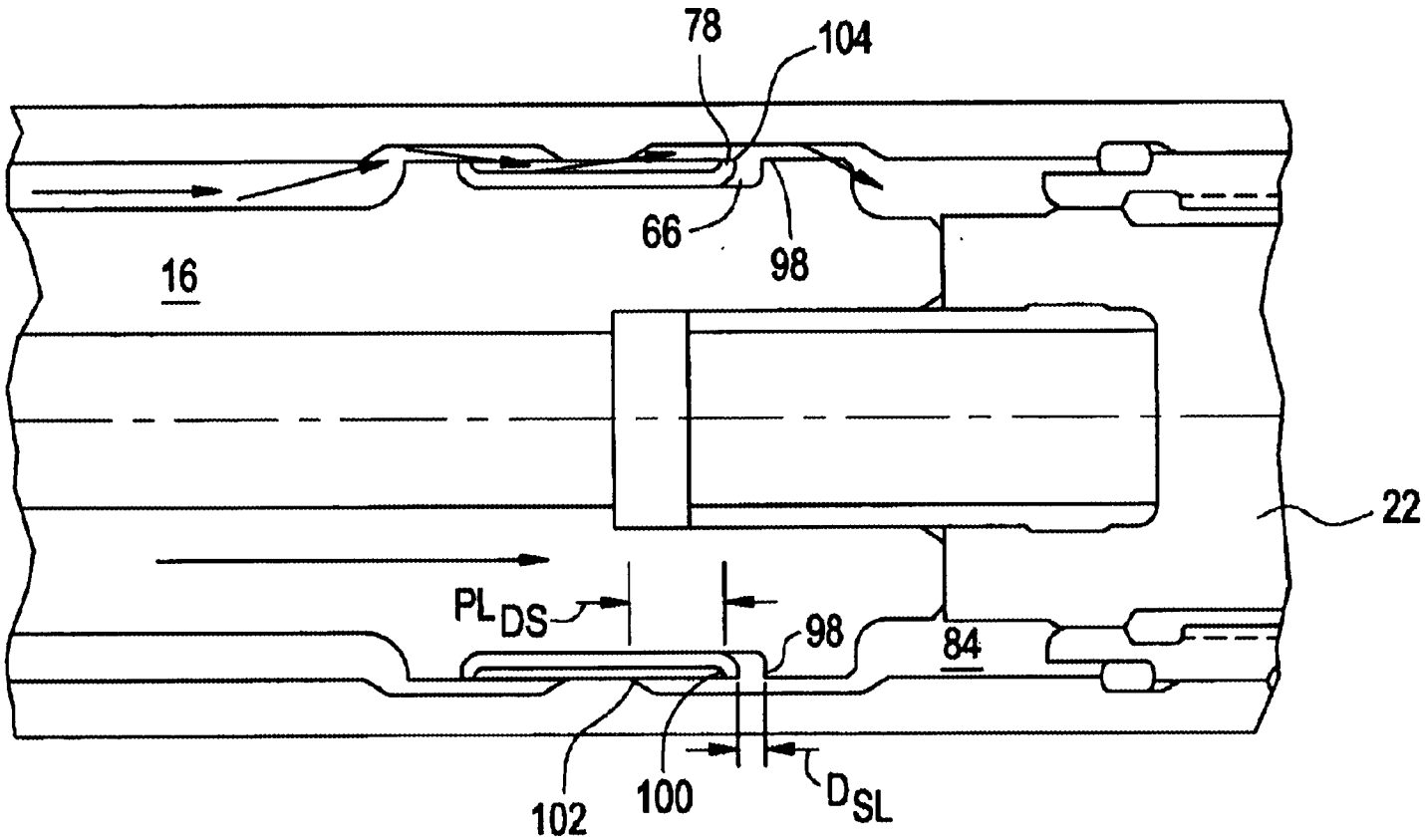

On the piston downstroke, pressure fluid cannot be supplied to the front chamber 84 until both the upper edge 98 of the lower shoulder 70 and the upper edge 100 of the lower leg 78 have traveled past the lower edge 102 of flange 56. As shown in FIG. 2*a*, pressure fluid is supplied into the sleeve cavity 82 after upper shoulder 68 no longer sealingly engages the inner surface 20 of the outer cylinder 16. Since the sleeve 74 is positioned in the upper portion of groove 66 during the downstroke, the outer surface of the sleeve lower leg 78 is positioned to sealingly engage the flange 56 located between upper fluid passage 52 and lower fluid passage 54 when upper shoulder 68 moves into registration with upper fluid passage 52. Although pressure fluid flows through upper fluid passage 52 into the sleeve cavity 82, further flow is blocked by the seal between the sleeve lower leg 78 and land 56 until the sleeve lower leg 78 moves into registration with lower fluid passage 54 (FIG. 2*b*). As explained above, sleeve 74 remains positioned in the upper portion of groove 66 until the downstroke has been completed (when the piston 14 impacts the bit 22). Accordingly, the maximum axial length $PL_{DS}$ of the port 96 during the piston downstroke is equal to the axial distance between upper edge 100 of lower leg 79 and the lower edge 102 of flange 56 at the moment when piston 14 impacts bit 22, before sleeve 74 moves within groove 66, as shown in FIG. 2*b*.

Figure 2C:
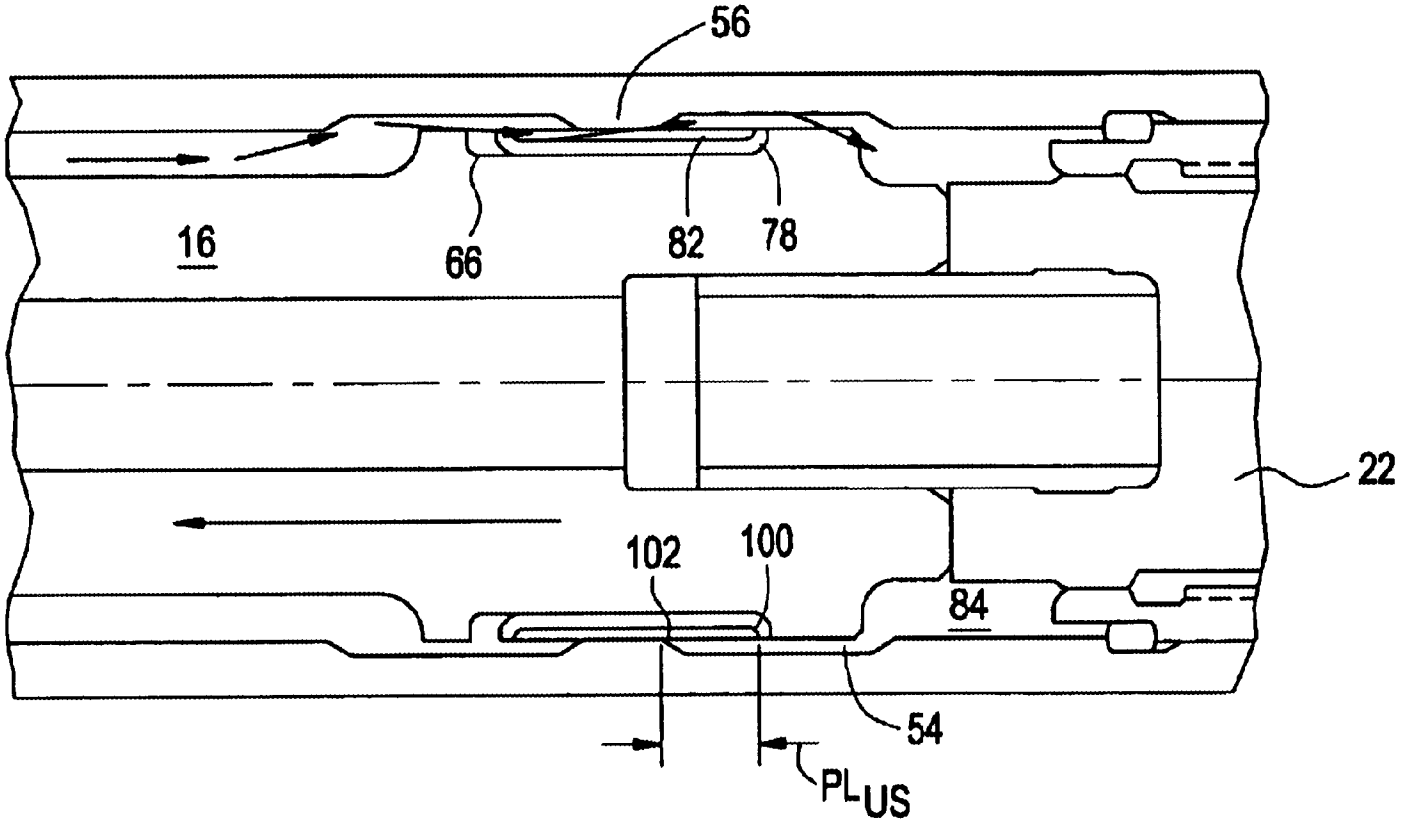
Figure 2D:
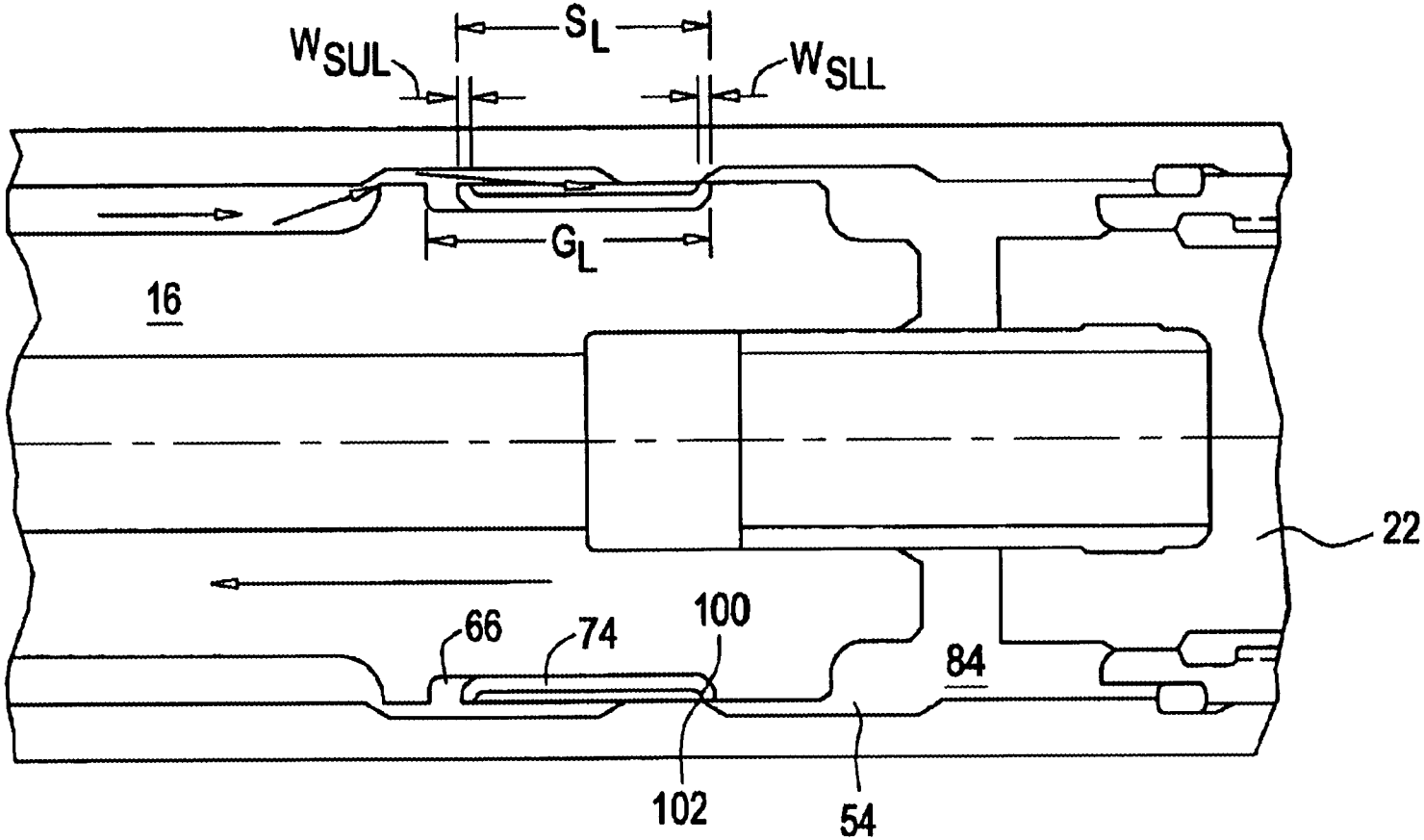

As shown in FIG. 2*c*, the sleeve cavity 82 remains in registration with lower fluid passage 54 after piston impact, when the sleeve 74 moves axially downward within groove 66. Pressure fluid continues to be supplied to the front chamber 84 until the sleeve lower leg 78 moves into registration with the land 56 and forms a substantially fluid tight seal with the land 56 (FIG. 2*d*). Accordingly the maximum axial length $PL_{US}$ of the port 96 during the piston upstroke is equal to the axial distance between upper edge 100 of lower leg 79 and the lower edge 102 of flange 56 just after piston 14 has impacted bit 22, at the moment when sleeve 74 has completed moving within groove 66 to the upstroke position 108, as shown in FIG. 2*c*.

As shown by comparing FIGS. 2*b* and 2*c*, $PL_{US}=PL_{DS}+D_{SL}$, where DSL is the axial distance of travel of the sleeve 74 when the sleeve 74 moves from the downstroke position 106 to the upstroke position 108. It should be appreciated that $D_{SL}$ is equal to the distance between the upper edge 98 of lower shoulder 70 and lower edge 104 of lower leg 78. Generally, the sleeve will be symmetrical and the axial width $W_{SUL}$ of the sleeve upper leg 76 is substantially equal to the axial width $W_{SLL}$ of the sleeve lower leg 78. In this case, the maximum axial length $PL_{US}$ of the port 96 during the piston upstroke is also equal to $PL_{DS}+(G_L-S_L)$, where $G_L$ is the axial length of groove 66 and SL is the axial length of sleeve 74.

It should be appreciated that for a port 96 having an axial length $PL_{US}$ for producing a piston upstroke equivalent to a conventional downhole impact drill, the axial length $PL_{DS}$ of the port 96 during the downstroke of the subject drill 10 is shorter than that of the conventional drill by a value equal to $W_{SLL}$ plus the axial distance $D_{SL}$ between the upper side of the lower shoulder 70 and the lower surface of the sleeve lower leg 78. The shorter axial length $PL_{DS}$ of the port 96 during the downstroke reduces the time period during the downstroke during which pressure fluid may be supplied to the front chamber 84, thereby reducing the impeding force of the piston 14 during the downstroke. Accordingly, the efficiency of the drill 10 and the rate of drilling shall be greater than a conventional downhole impact drill.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a downhole impact drill comprising an elongated cylinder; a distributor fixedly mounted in the cylinder and dividing the cylinder into a pressure fluid inlet plenum and an operating chamber; an impact piston with oppositely disposed impact and non-impact ends and upper and lower end portions mounted in the operating chamber, the piston being movable with a downstroke between a recovery position and an impact position and with an upstroke between the impact position and the recovery position, the piston dividing the operating chamber into non-impact and impact ends and dividing the cylinder into upper and lower end portions; and exhaust means for selectively connecting either the impact end of the operating chamber or the non-impact end of the operating chamber to exhaust; the cylinder lower end portion defining at least one upper fluid passage, at least one lower fluid passage, and a land having a sealing surface disposed therebetween; the piston lower end portion defining a circumferential groove having an axial length ($G_L$) and forming circumferential upper and lower shoulders, each of the shoulders having an outer surface; the drill further comprising a U-shaped sleeve mounted within the piston groove, the sleeve having a base and upper and lower legs extending radially outward from the base to an outer surface, the upper and lower legs defining an axially extending cavity therebetween, the sleeve having an axial length ($SC_L$) that is less than the axial length of the piston groove, the sleeve being slidably movable within the piston groove between an upstroke position and a downstroke position; the at least one upper fluid passage and the at least one lower fluid passage cooperating with the cavity of the sleeve as the piston reciprocates between the impact position and the recovery position whereby the impact end of the operating chamber is supplied with pressure fluid from the pressure fluid inlet plenum for a portion of each upstroke and a portion of each downstroke; wherein the portion of each downstroke during which pressure fluid is supplied to the impact end of the operating chamber is less than the portion of each upstroke during which pressure fluid is supplied to the impact end of the operating chamber.

2. The drill of claim 1 wherein the sleeve comprises first and second ring halves, the ring halves being mounted together.

3. The drill of claim 1 wherein the sleeve is composed of a high impact strength composite polymer material.

4. The drill of claim 1 wherein the base of the sleeve and the groove of the piston lower end portion provide a fluid seal therebetween.

5. The drill of claim 1 wherein the sleeve lower leg is in contact with the lower shoulder of the piston lower end portion when the sleeve is in the upstroke position and the sleeve upper leg is in contact with the upper shoulder of the piston lower end portion when the sleeve is in the downstroke position.

6. The drill of claim 5 wherein the sleeve cavity and the piston lower end portion groove define a port for the passage of pressure fluid around the cylinder lower end portion land, the port having an axial length ($PL_{US}$) when the sleeve is in the upstroke position and an axial length ($PL_{DS}$) when the sleeve is in the downstroke position, wherein $PL_{US}>PL_{DS}$.

7. The drill of claim 6 wherein the sleeve upper and lower legs each have an axial width ($W_{SUL}$, $W_{SLL}$), wherein $PL_{US}=G_L-W_{SLL}$ and $PL_{DS}=SC_L$.

8. The drill of claim 7 wherein $W_{SUL}$ is substantially equal to $W_{SLL}$.

9. The drill of claim 1 wherein the surfaces of the piston lower end portion upper and lower shoulders cooperate with the cylinder to provide a fluid seal over a portion of each upstroke and each downstroke and the sleeve upper and lower legs cooperate with the cylinder to provide a fluid seal over a portion of each upstroke and each downstroke.

10. The drill of claim 9 further comprising a sheath disposed within the upper end portion of the cylinder, the sheath and the cylinder defining an axially extending fluid passage, the sheath defining at least one bore providing fluid communication between the pressure fluid inlet plenum and the fluid passage.

11. The drill of claim 10 wherein the piston defines a circumferential intermediate groove between the piston upper end portion and the piston lower end portion.

12. The drill of claim 11 wherein the piston upper end portion and the sheath cooperate to provide a fluid seal over each upstroke and each downstroke and the sheath defines at least one axially extending recess bypassing the fluid seal between the piston upper end portion and the sheath over a portion of each upstroke and a portion of each downstroke to provide fluid communication between the piston intermediate groove and the non-impact end of the operating chamber.

13. In a downhole impact drill comprising an elongated cylinder; a distributor fixedly mounted in the cylinder and dividing the cylinder into a pressure fluid inlet plenum and an operating chamber, an impact piston with oppositely disposed impact and non-impact ends and upper and lower end portions mounted in the operating chamber, the piston being movable with a downstroke between a recovery position and an impact position and with an upstroke between the impact position and the recovery position, the piston dividing the operating chamber into non-impact and impact ends and dividing the cylinder into upper and lower end portions; and exhaust means for selectively connecting either the impact end of the operating chamber or the non-impact end of the operating chamber to exhaust; the cylinder lower end portion defining at least one upper fluid passage, at least one lower fluid passage, and a land having a sealing surface disposed therebetween; the piston lower end portion defining a circumferential groove having an axial length ($G_L$) and forming circumferential upper and lower shoulders, each of the shoulders having an outer surface; the drill further comprising a U-shaped sleeve mounted within the piston groove, the sleeve having a base and upper and lower legs extending radially outward from the base to an outer surface, the upper and lower legs defining an axially extending cavity therebetween, the sleeve having an axial length ($SC_L$) that is less than the axial length of the piston groove, the sleeve being slidably movable within the piston groove between an upstroke position, where the sleeve lower leg is in contact with the lower shoulder of the piston lower end portion, and a downstroke position where the sleeve upper leg is in contact with the upper shoulder of the piston lower end portion; the sleeve cavity and the piston lower end portion groove defining a port having an axial length ($PL_{US}$) when the sleeve is in the upstroke position and an axial length ($PL_{DS}$) when the sleeve is in the downstroke position, wherein $PL_{US}>PL_{DS}$; the at least one upper fluid passage and the at least one lower fluid passage cooperating with the port as the piston reciprocates between the impact position and the recovery position whereby the impact end of the operating chamber is supplied with pressure fluid from the pressure fluid inlet plenum for a portion of each upstroke and a portion of each downstroke.

14. The drill of claim 13 wherein the sleeve lower leg has an axial width ($W_{SLL}$), wherein $PL_{US}=G_L-W_{SLL}$ and $PL_{DS}=SC_L$.

15. The drill of claim 14 further comprising a sheath disposed within the upper end portion of the cylinder, the sheath and the cylinder defining an axially extending fluid passage, the sheath and the piston upper end portion cooperating to provide a fluid seal over each upstroke and each downstroke; the piston defining a circumferential intermediate groove between the piston upper end portion and the piston lower end portion, the intermediate groove being in fluid communication with the fluid passage; the sheath defining at least one bore, providing fluid communication between the pressure fluid inlet plenum and the fluid passage, and at least one axially extending recess, bypassing the fluid seal between the piston upper end portion and the sheath over a portion of each upstroke and a portion of each downstroke to provide fluid communication between the piston intermediate groove and the non-impact end of the operating chamber.

16. The drill of claim 15 wherein the at least one upper fluid passage is in fluid communication with the piston intermediate groove over a portion of each upstroke and a portion of each downstroke to provide fluid communication between the pressure fluid inlet plenum and the impact end of the operating chamber.

17. In a downhole impact drill comprising an elongated cylinder; a distributor fixedly mounted in the cylinder and dividing the cylinder into a pressure fluid inlet plenum and an operating chamber; an impact piston mounted in the operating chamber, the piston having oppositely disposed impact and non-impact ends, upper and lower end portions, and a circumferential intermediate groove between the upper and lower end portions, the piston being movable with a downstroke between a recovery position and an impact position and with an upstroke between the impact position and the recovery position, the piston dividing the operating chamber into non-impact and impact ends and dividing the cylinder into upper and lower end portions; a sheath disposed within the upper end portion of the cylinder, the sheath and the piston upper end portion cooperating to provide a fluid seal over each upstroke and each downstroke, the sheath and the cylinder defining an axially extending passage in fluid communication with the piston intermediate groove, the sheath defining at least one bore, providing fluid communication between the pressure fluid inlet plenum and the fluid passage, and a plurality of axially extending recesses, bypassing the fluid seal between the piston upper end portion and the sheath over a portion of each upstroke and a portion of each downstroke to provide fluid communication between the pressure fluid inlet plenum and the non-impact end of the operating chamber; and exhaust means for selectively connecting either the impact end of the operating chamber or the non-impact end of the operating chamber to exhaust; the cylinder lower end portion defining a plurality of upper fluid passages, a plurality of lower fluid passages, and a land having a sealing surface disposed therebetween, the upper fluid passages being in fluid communication with the piston intermediate groove over a portion of each upstroke and a portion of each downstroke; the piston lower end portion defining a circumferential groove having an axial length ($G_L$) and forming circumferential upper and lower shoulders, each of the shoulders having an outer surface; the drill further comprising a U-shaped sleeve mounted within the piston groove, the sleeve having a base and upper and lower legs extending radially outward from the base to an outer surface, the lower leg having an axial width ($W_{SLL}$), the upper and lower legs defining an axially extending cavity therebetween, the sleeve having an axial length ($SC_L$) that is less than the axial length of the piston groove, the sleeve being slidably movable within the piston groove between an upstroke position, where the sleeve lower leg is in contact with the lower shoulder of the piston lower end portion, and a downstroke position where the sleeve upper leg is in contact with the upper shoulder of the piston lower end portion; the sleeve cavity and the piston lower end portion groove defining a port having an axial length ($PL_{US}$) when the sleeve is in the upstroke position and an axial length ($PL_{DS}$) when the sleeve is in the downstroke position, wherein $PL_{US}>PL_{DS}$, $PL_{US}=G_L-W_{SLL}$ and $PL_{DS}=SC_L$; the upper fluid passages and the lower fluid passages cooperating with the port as the piston reciprocates between the impact position and the recovery position whereby the impact end of the operating chamber is supplied with pressure fluid from the pressure fluid inlet plenum for a portion of each upstroke and a portion of each downstroke.

* * * * *